United States Patent [19]

Mutschler

[11] Patent Number: 4,523,915

[45] Date of Patent: Jun. 18, 1985

[54] REVERSE WEAVING MECHANISMS

[75] Inventor: Ulrich Mutschler, Caluire, France

[73] Assignee: Staubli-Verdol, Chassieu, France

[21] Appl. No.: 515,085

[22] Filed: Jul. 18, 1983

[30] Foreign Application Priority Data

Jul. 19, 1982 [FR] France ..... 82 12849

[51] Int. Cl.[3] ..... D03D 49/20

[52] U.S. Cl. ..... 464/3; 139/309; 464/73

[58] Field of Search ..... 464/1, 3, 4, 5, 6, 73–76, 464/160; 139/304, 116, 309, 128, 224, 256

[56] References Cited

U.S. PATENT DOCUMENTS

| | | | |
|---|---|---|---|
| 1,641,230 | 9/1927 | Manville | 464/3 X |
| 1,862,864 | 6/1932 | Schouten | 464/3 |
| 1,898,806 | 2/1933 | Baker | 464/3 |
| 1,999,364 | 4/1935 | Lang | 464/1 |
| 2,653,458 | 9/1953 | Andrews | 464/3 X |
| 2,658,362 | 11/1953 | Spengler | 464/3 |

*Primary Examiner*—John Petrakes

*Attorney, Agent, or Firm*—Dowell & Dowell

[57] ABSTRACT

A coupling device for coupling a loom shaft to the shaft of a weft selecting device in a weaving loom, the device comprising two opposed discs having mutually engaging teeth which automatically respond to reversal in direction of rotation of the loom shaft to introduce a desired phase shift between the loom shaft and the weft shaft, the coupling device having automatic means for locking the disc teeth after each reversal in direction of the loom to maintain the newly phase-shifted mutual orientation of the discs.

7 Claims, 11 Drawing Figures

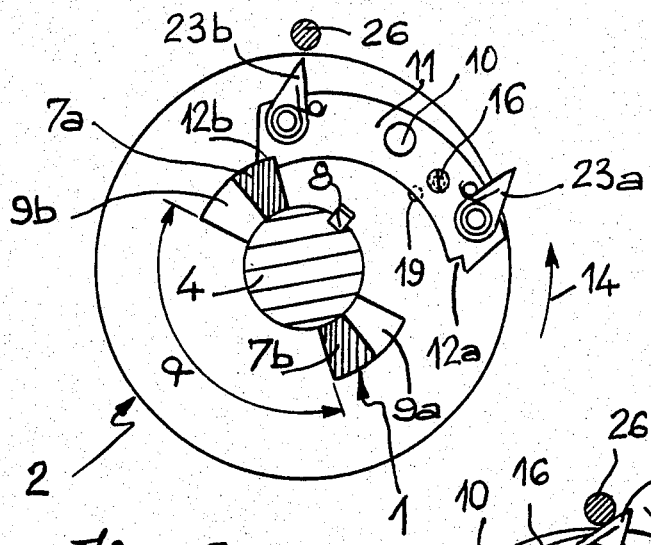
Fig. 10
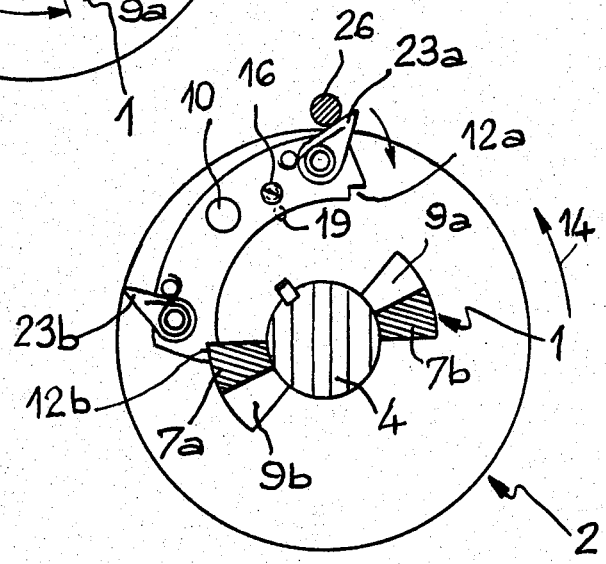
Fig. 11
Fig. 4
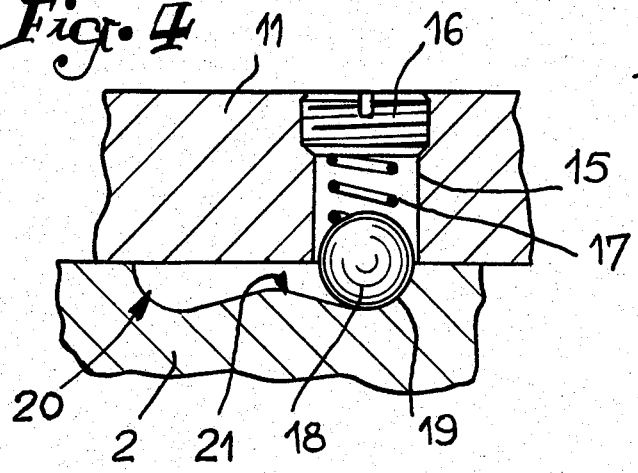

REVERSE WEAVING MECHANISMS

It is known that it is frequently necessary to rotate a weaving loom in reverse in order to remedy defects appearing on the fabric. What is called an "unweaving" may be effected, i.e. the picks previously made are removed one by one until the defective zone has been eliminated and, after having remedied the cause of the defect noted, normal operation is resumed without this operation of correction affecting in any way the appearance of the finished product. However, in the case of looms incorporating weaving mechanisms, for example of the Verdol type, a basic difficulty is encountered, namely the correct selection of the warp yarns is no longer effected if one limits oneself simply to reversing the direction of rotation of the shaft of the loom. In fact, during normal operation of such a mechanism, there is firstly selection of the hooks, then lifting by the gripper frame of the hooks thus selected. As a result, if the cycle is not modified, during operation in reverse, the gripper frame will execute its lifting movement without the hooks having been selected. Depending on whether, in the mechanism in question, the pushed hooks are either retracted with respect to the blades of the frame or brought to the position of engagement therewith, either all the hooks would come into high position, or all would remain in low position. In one case as in the other it would be impossible to disengage in reverse operation the last pick of the fabric.

To solve the problem thus raised by the irreversibility of the operational cycle of the mechanisms of the type in question (mechanisms with hooks and the like), means are generally provided for reversing the sequential succession of the selection of the hooks and the lifting of the grippers in the operational cycle of the mechanism, i.e. in practice for phase-shifting the movement of the selection needles with respect to the vertical reciprocating movement of the grippers. These means are often controlled by hand, which involves work by the operator and may give rise to accidents if he forgets to actuate the control members before and after the reverse operation of the loom. Mechanisms have also been proposed which are connected to the lever for reversing the direction of operation, and which automatically carry out the necessary operations, but these mechanisms are complicated, expensive and sometimes subject to failure.

Attempts have been made to overcome these drawbacks with the aid of a very simple device in which the shaft of the mechanism is driven via a coupling comprising an angular lost-motion clearance equal to the necessary phase shift angle. When the direction of rotation of the loom is reversed, the two elements or members constituting this coupling rotate with respect to each other through the angle provided. However, for such a device to operate perfectly without the two said members oscillating with respect to each other under the effect of the vibrations and irregularities of the torque transmitted, it is necessary to brake the driven member fairly strongly and this causes losses of power with inadmissible overheating, particularly in modern high-speed looms. The brake must in addition include cooling members and its action must be constant, so that it turns out to be an expensive accessory of which, in addition, the linings wear out fairly quickly and must therefore be frequently replaced.

It is an object of the present invention to improve this known device so as to maintain the advantages thereof—considerable simplicity and absence of accessory mechanisms—whilst completely eliminating all braking and consequently any complicated accessory member with the losses of power and overheating problems.

According to the invention, a coupling device with angular lost motion clearance adapted to ensure the drive phase-shift necessary for correct operation in reverse of a weaving loom mechanism, then for resuming forward operation, comprises means which, during a reversal of direction, lock the two members of the coupling with each other as soon as the device begins to rotate in a direction different from that in which it rotated before.

In a preferred embodiment, the two members in question are made in the form of plates or discs of which the opposite faces are provided with axially extending interengaging teeth adapted to ensure their angular connection whilst forming the necessary phase-shift angle during reversal of operation. Furthermore, the driven disc bears a locking lever which is articulated thereon about an axially extending axis suitably offset with respect to the general axis of the device. The ends of this lever are shaped, for example by means of notches, so as to be able to come into engagement on the adjacent tooth of the driving member in order to lock it in place in one or the other of its two stop positions with respect to the driven shaft. This lever bears at its ends pawls with return springs, the pawls projecting outwardly and adapted to cooperate on passage with a fixed stop. The pawl which is located upstream in the direction of the movement is retracted in the direction of the axis with respect to the stop, whilst the outer pawl may freely retract itself by rotation about its axis on passage opposite this stop for as long as rotation occurs in the same direction, but, on the contrary, locks against an individual stop borne by the lever as soon as the direction of rotation reverses, obliging the corresponding end of this lever to move closer to the centre and thus cause tipping of said lever which then locks the adjacent tooth of the driving member in its new position (phase-shifted with respect to the preceding one). An appropriate yieldable detent maintains the lever in its end of stroke positions and returns it thereto when it moves away therefrom somewhat. The lever itself is shaped so that, if it has completely tipped before the corresponding tooth has totally covered the phase-shift angle, the tooth may displace it slightly to be able to pass to its end of stroke position, the lever returning to block the tooth in said end stroke position.

The whole device being symmetrical, it operates in the same manner during return to forward operation and during passage from forward operation to reverse operation.

In any case, once the driving tooth is blocked, the coupling device according to the invention prevents any substantial relative angular displacement of the driving and driven members and thus totally eliminates all braking system or the like.

The accompanying drawing, given by way of example, will enable the invention, the characteristics that it presents and the advantages that it can procure, to be more readily understood.

FIG. 4 is a detailed section of detent means for elastically clipping the locking lever on the driven disc.

Figure 9:
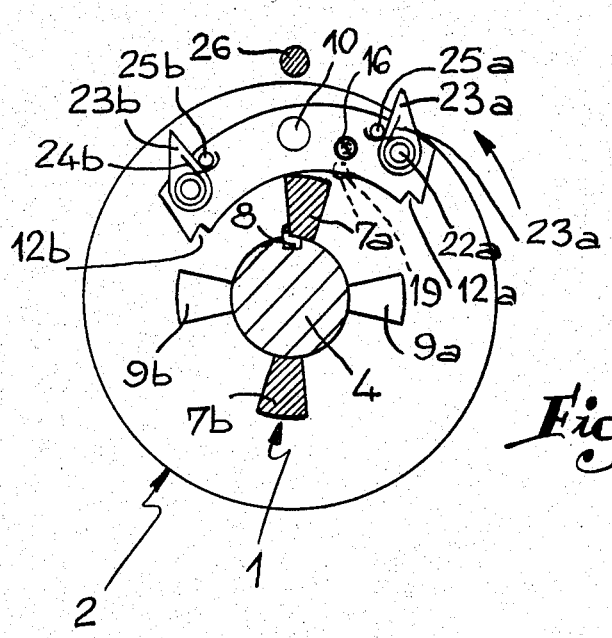

FIG. 9 corresponds to the case when, during this disengagement, the mobile disc has continued its stroke somewhat, for example by effect of inertia.

FIG. 10 shows the positions of the parts after locking of one of the driving teeth, i.e. once the process of reversal has completely terminated.

FIG. 11 reproduces FIG. 10, but showing how the pawl, previously retracted inwardly and now pushed outwardly, is inclined and retracts on passage in front of the stop pin.

Figure 1:
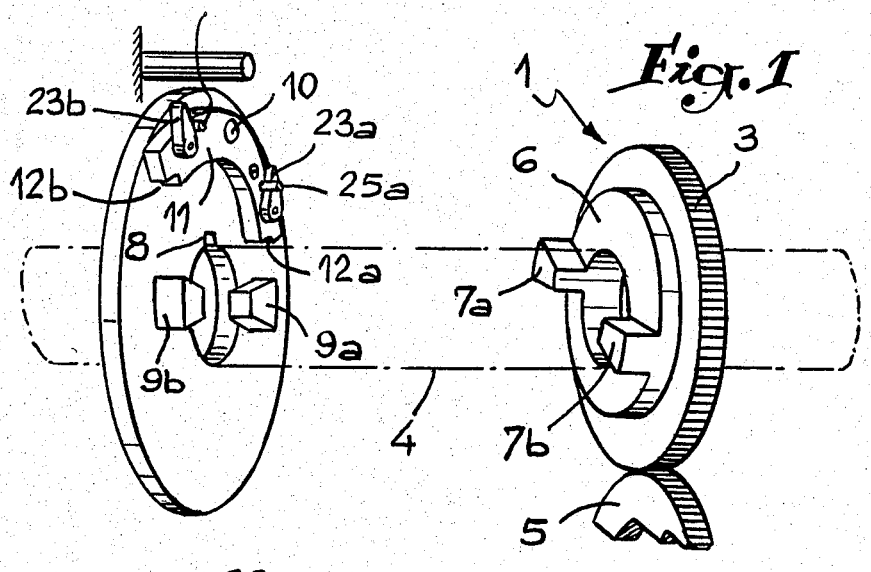
FIG. 1 is a view in perspective showing the opposite faces of the two discs of the coupling device according to the invention, in the spaced apart state.
Figure 2:
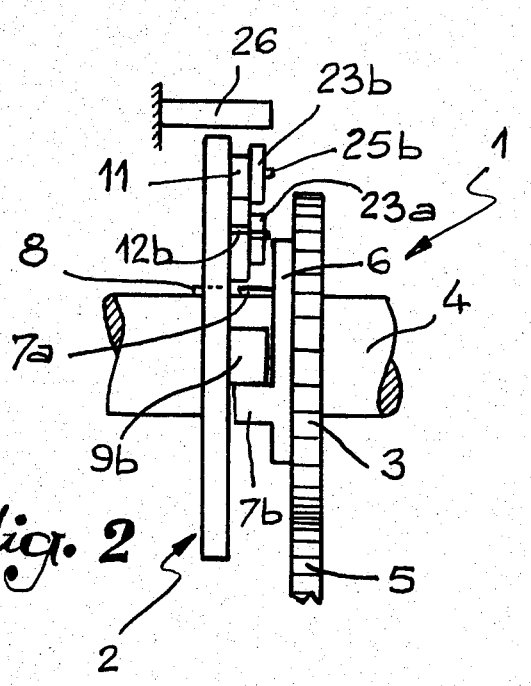
FIG. 2 is a side view of the assembled coupling.

The coupling shown in FIG. 1 comprises a driving element and a driven element respectively designated by general references 1 and 2. These two elements are in the form of discs of reduced thickness disposed at a short distance from each other along the same axis, as shown in FIG. 2. They are shown spaced apart in FIG. 1 to show their opposite faces in detail. The driving disc 1 is constituted by a flat toothed pinion 3 mounted idly on the common shaft 4 and driven by another pinion 5 suitably connected to the drive shaft of the loom, the inner face of this pinion 3, i.e. that facing the disc 2, carries a coaxial projecting part 6 in the form of a plate of smaller diameter than the said pinion, which plate bears two diametrically opposite lateral teeth 7*a* and 7*b*, extending towards the second disc 2. The disc 2 is keyed on the selection shaft 4, as indicated by key 8. On its inner face (that facing the first disc 1) there are provided two lateral teeth 9*a* and 9*b*, likewise diametrically opposite each other and adapted to cooperate with teeth 7*a* and 7*b* mentioned above to ensure the angular connection between the two discs 1 and 2. The four teeth 7*a*, 7*b*, 9*a*, 9*b* each occupying clearly less than 45°. Thus, it will be understood that this connection provides a fairly large angle of lost motion or dead stroke (of the order of 135° in the example shown).

Figure 3:
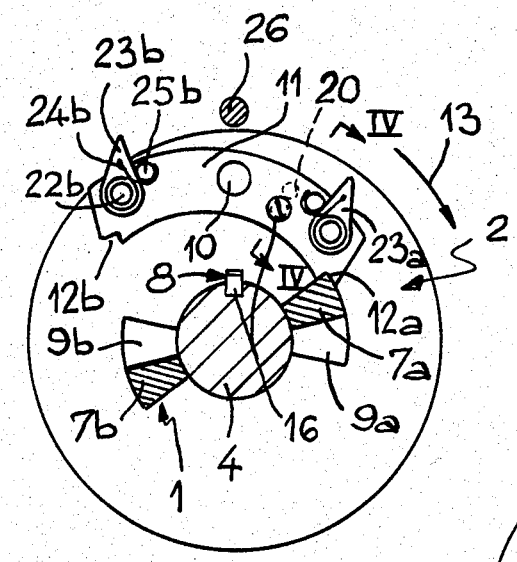
FIG. 3 is a transverse section through the plane of the base of the teeth of the driving disc, the device being in position for normal, forward operation.

The second plate 2 further bears on its inner face a pin 10 located at a shot distance inside its periphery and on which is articulated at its centre a double lever 11 curved in the form of an arc of circle. Each of the ends of the lower edge of this lever (the edge facing the shaft 4) is notched so as to provide a notch 12*a*, 12*b* of square section. The lever 11 is dimensioned so that, when the teeth 7*a*, 7*b* are in contact with teeth 9*a*, 9*b* for driving the disc 2 in one direction (clockwise in the direction of arrow 13 in FIG. 3, for example), the notch 12*a* which is located at the upstream end of the lever (the term "upstream" referring to the direction of rotation of this lever) will engage on that corner of the periphery of the adjacent tooth 7*a* which is not in contact with the corresponding tooth 9*a*, as shown in FIG. 3, thus imprisoning this tooth 7*a* between tooth 9*a* and the lever 11, i.e. positively locking the disc 2 with respect to disc 1.

It will be understood that, under these conditions, the lever 11 will have two locking positions, one for rotation in one direction (clockwise direction in FIG. 3), the other for rotation in the opposite direction (counterclockwise in the direction of arrow 14 in FIG. 10). To avoid any untimely disengagement under the effect of the vibrations, slight unbalance or the like, a detent engagement incorporating ball and spring is provided, such as the one indicated in FIG. 4. Here, a bore 15 has been provided in lever 11, closed on the outside by a screw-down stopper 16 against which abuts a spring 17 adapted to push a ball 18 against the inner face of the disc 2. Said face is hollowed with two depressions 19 and 20 in each of which the ball may engage. These depressions are joined to each other by a zone 21 in the form of a double inclined plane in order that, as soon as the ball has passed the summit of this double plane, it tends to guide the lever to its closest end of stroke, without maintaining it in an intermediate position. In addition, the depressions 19, 20 are in the form of demi-spheres so as to prevent the ball 18, and consequently the lever 11, from going beyond the useful stroke provided.

Each of the ends of the lever 11 bears a pin 22*a*, 22*b* on which is articulated a pawl 23*a*, 23*b* which a spring 24*a*, 24*b* tends to guide against an adjacent stop 25*a*, 25*b* to a position of rest in which the tip of the pawl is oriented outwardly away from the shaft 4. The arrangement of springs 24*a*, 24*b* is such that, in this position of rest of the pawls, they urge the latter to rotate in a direction bringing their tips closer to one another (viz. in FIG. 3 counterclockwise for pawl 23*a* and clockwise for the other 23*b*).

The pawls 23*a*, 23*b* are in addition dimensioned so that, when the lever 11 is in one of its locking positions, the one located at the end of the lever where the notch 12*a* or 12*b* is in engagement with tooth 7*a* or 7*b* is totally retracted radially inside the periphery of the disc 2 (pawl 23*a* in FIG. 3) whilst the tip of the other projects far beyond it.

Finally, a fixed abutment in the form of a pin 26 oriented parallel to the shaft 4 and located in the immediate vicinity of the periphery of the disc 2 is provided on the fixed frame of the mechanism.

Operation is as follows:

If it is assumed, for the sake of discussion, that during normal operation of the loom the disc 1 rotates in clockwise direction (arrow 13), lever 11 has tipped in this same direction and its notch 12*a* has come to lock the tooth 7*a* with respect to disc 2, the ball 18 being located in depression 19 to retain the lever in this position. The tip of pawl 23*a* is retracted and the tip of the other pawl 23*b* projects beyond the periphery of disc 2. To within the inevitable very small clearances, the coupling operates like a rigid piece and allows no oscillation, whatever the variations of the torque transmitted may be, even if the latter is momentarily reversed, as may sometimes occur in weaving mechanisms, this being achieved without it being necessary to provide a retaining braking means.

Figure 5:
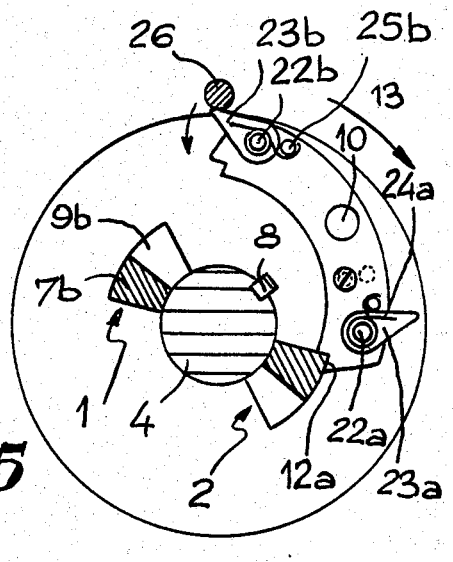
FIG. 5 is a view similar to that of FIG. 3, but showing the positions of the parts at the moment when the pawl, not retracted towards the axis is deviated by the fixed stop pin.

Each time the pawl 23*b* passes opposite the pin 26, FIG. 3, the latter comes into contact with its tip thus tending to make it rotate in the direction allowed by stop 25*b*, i.e. to move it away from the tip of the other pawl 23*a*. The pawl 23*a* therefore retracts momentarily, as shown in FIG. 5 and the operation of the mechanism is in no way hindered.

Figure 6:
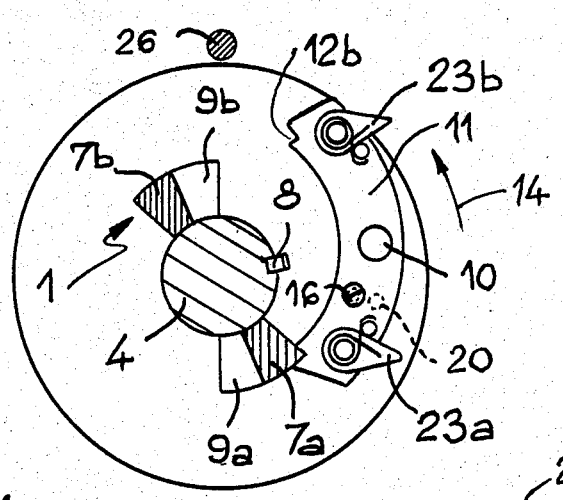
FIG. 6 is also a view similar to that of FIG. 3, but showing the positions of the parts at the beginning of reversal of the direction of rotation.

If the direction of rotation of the loom, therefore of disc 1 is reversed, (FIG. 6, arrow 14), initially the tooth 7*a*, still in engagement with notch 12*a*, will drive the lever 11 and consequently the disc 2 will rotate reversely without any phase shift with respect to disc 1. However, as soon as the pawl 23*b* comes into contact with the pin 26, FIG. 7, it cannot retract since, to this end, it would be necessary for it to rotate on its pin 22*b* in the direction prohibited by stop 25*b*. By reason of the inclination of the flank of this pawl where it contacts the abutment pin 26, the corresponding end of the lever 11 will be pushed inwardly toward the shaft 4. The lever will therefore tip somewhat and its notch 12*a* will release tooth 7*a* (FIG. 8). From that instant, the teeth 7*a* and 7*b* (which act as driving members) will be able to rotate independently of disc 2 until the tooth 7*a* has come to bear against tooth 9*b* and the second against tooth 9*a*, as shown in FIG. 10. The disc 1 will therefore reversely drive disc 2, shaft 4 and the mechanism counterclockwise, but with a predetermined phase shift (FIG. 10) with respect to the case of forward operation. There again, the rotation will not be hindered by the pawls, the first pawl 23*b* now being in position retracted towards the axis with respect to the pin 26 and the pawl 23*a* tipping freely on passage of the pin 26, as shown in FIG. 11.

Figure 7:
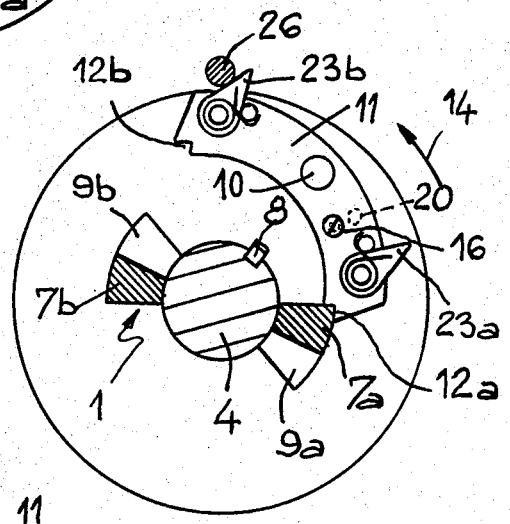
FIG. 7 shows them a moment after, when the pawl, non-retracted towards the axis, abuts against the fixed pin.
Figure 8:
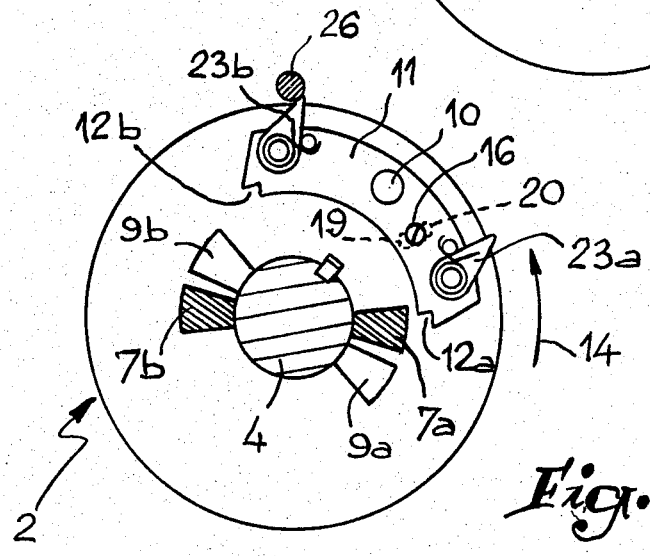
FIG. 8 shows them at the instant of disengagement of the previously locked driving tooth.

In fact, the passage from the position of FIG. 7 to that of FIG. 10 may be effected in one of three ways depending on the inertias and resistant torques coming into play.

1. If the frictions are relatively sizeable with respect to the other torques and particularly to those resulting from the masses and/or weights of the mobile pieces, the disc 2 will stop immediately after the tooth 7*a* has been disengaged and before the lever 11 has completely tipped. It will be therefore in its position of FIG. 8. Immediately the tooth 7*a* has begun to drive tooth 9*b*, the disc 2 will begin to rotate reversely and, the pawl 23*b* will pass under pin 26, completely lowering the corresponding end of the lever so that the position of FIG. 10 is thus attained.

2. If, on the contrary, the effects of inertia and/or the torques resulting from the weight of the lever parts lifted and acting in the reverse direction are considerable, the pawl 23*b* will stop only after having passed beyond the pin 26 and thus cause the complete tipping of lever 11, as shown in FIG. 9. Tooth 7*a* will therefore touch the inner edge of this lever at the portion thereof located beyond pin 10 in the direction of reverse rotation. It will lift the latter very slightly on passage, and then this part of the lever will lower behind the tooth so that, there again, the parts will be in the position of FIG. 9. It should be noted in this respect that the double inclined plane 21 of FIG. 4 is such as to promote this return to the engaged position of lever 11 momentarily displaced very slightly on passage of tooth 7*a*.

3. Finally, it may happen that the weight of the tilted lower parts will be such that, as soon as the tooth 7*a* has been disengaged from notch 12*a*, the disc 2 will rotate by itself in the forward direction (direction of arrow 13). In this case, the lever 11 will not have tipped. The tooth 7*b* will therefore engage in the notch 12*a* to drive the disc 2 reversely. The parts will be found in a position similar to the successive positions of FIGS. 6 and 7, except that the driven teeth 9*a* and 9*b* will be respectively against the rear face of teeth 7*b* and 7*a*. However, as shaft 4 will have had the time to get up speed, when the pawl 23*b* will have lowered on passage beneath pin 26, the disc 2 will not stop immediately, so that tooth 7*b* will have the possibility of engaging in notch 12*a*. There again, the parts will return to the position of FIG. 10.

When, after having placed the loom in reverse operation to remove a defect, the operator resumes forward operation, then, since the device which has just been described is perfectly symmetrical, operation remains, mutatis mutandis, identically the same as that set forth hereinabove. The parts therefore return to the position of FIGS. 3 and 5 after having ensured phase shifting in a direction opposite what took place at the beginning of reverse operation.

It must, moreover, be understood that the foregoing description has been given only by way of example and that it in no way limits the domain of the invention, which would not be exceeded by replacing the details of execution described by any other equivalents. Discs 1 and 2 could be mounted on two shafts disposed end to end, or alternatively with one on a central shaft and the other on a hollow shaft surrounding the latter. Instead of flat discs, any type of member capable of supporting lateral teeth and having a transverse face adapted to bear the tipping lever 11 might be provided.

I claim:

1. A coupling device for connecting drive from a loom shaft driving the grippers in a weaving loom to a drive shaft for weft selecting means, and for shifting the phase of the drive through a desired angle when the direction of the loom is reversed between its normal forward drive and reverse drive, the coupling device comprising:

(a) a driven disc fixed to said selecting means shaft to rotate the latter therewith and having annularly spaced driven tooth means;

(b) a drive disc disposed axially opposite said driven disc and rotatable with respect thereto and having drive tooth means extending axially toward the driven disc and interengaging with the driven tooth means thereon, the drive tooth means and the driven tooth means being annularly spaced to provide lost-motion angular clearance equaling the desired angle of phase shift when the loom direction is reversed;

(c) means coupled between the loom shaft and the drive disc for driving the latter by the former; and (d) lock means carried by the driven disc for engaging the tooth means of said drive disc and operative automatically in response to reversal of the direction of rotation of the loom to lock said discs in their respective phase-shifted orientations.

2. The coupling device as claimed in claim 1, wherein said locking means comprises a lever pivoted at its center to said driven disc about an axially oriented axis, and means operative in response to reversal of the direction of loom rotation to tilt the lever so that one of its ends engages a drive tooth means and maintains it locked in its newly phase-shifted position with respect to the driven disc.

3. The coupling device as claimed in claim 2, wherein said lever of the locking means supports at each end a pawl pivoted to the lever and the lever supports adjacent to each pawl an associated stop and at each pawl a spring acting between the lever and the pawl to urge the pawl against its stop to maintain the pawls oriented to extend generally away from the selecting means shaft, the stops facing in opposite directions with respect to the center of the lever; a fixed abutment located adjacent to the driven disc and operative to contact a pawl extending from the periphery of the driven disc and thereby drive it against its stop and cause the lever to tilt toward the selecting means shaft when the driven disc rotates in one direction, and operative to drive the pawl away from its stop and allow it to pass the abutment without tilting the lever when the driven disc rotates in the opposite direction, the pawl near the end of the lever which is in contact with a drive tooth means being located within the periphery of the driven disc, and the other pawl extending from the periphery toward the abutment.

4. The coupling device as claimed in claim 2, further including yieldable detent means located between the lever and the driven disc and operative to urge the lever to move definitely into one stable tilt position or the other.

5. The coupling device as claimed in claim 2, further including yieldable detent means located between the lever and the driven disc and operative to limit tilting motion of the lever to one of said stable positions.

6. The coupling device as claimed in claim 2, wherein the lever has an elongated edge located between its ends and facing toward said selecting means shaft, the edge being shaped and disposed with respect to the shaft such that a driving tooth while rotating with respect to the driven disc can raise the lever sufficiently to pass under said edge and lock behind the end of the lever without tilting the lever to the other detent stable position.

7. The coupling device as claimed in claim 6 wherein said elongated edge of the lever falls upon the arc of a circle which is concentric with the selecting means shaft when the lever is midway between its detent stable positions.

* * * * *